US005850967A

United States Patent [19]

White

[11] Patent Number: 5,850,967

[45] Date of Patent: Dec. 22, 1998

[54] SECURITY MAILBOX

[76] Inventor: J. La Nell White, 3418 Lansing Ave., Knoxville, Tenn. 37914

[21] Appl. No.: 31,427

[22] Filed: Feb. 26, 1998

[51] Int. Cl.[6] ..... B65D 91/00

[52] U.S. Cl. ..... 232/17; 232/45; 232/43.1

[58] Field of Search ..... 232/17, 45, 39, 232/19, 27, 28, 30, 31, 43.1; 70/279

[56] References Cited

U.S. PATENT DOCUMENTS

| | | | |
|---|---|---|---|
| D. 354,610 | 1/1995 | Hassan | 232/17 X |
| 660,329 | 10/1900 | Henry | 232/27 |
| 3,802,619 | 4/1974 | Vanderveer | 232/17 |
| 3,935,994 | 2/1976 | Darvishan | 232/17 X |
| 4,557,121 | 12/1985 | Charlton | 70/279 X |
| 4,651,544 | 3/1987 | Hungerford | 70/279 X |
| 4,815,656 | 3/1989 | Smith et al. | 232/17 X |
| 4,865,248 | 9/1989 | Barth | 232/24 |
| 4,869,425 | 9/1989 | Chiou | 232/17 |
| 5,000,378 | 3/1991 | Dorr et al. | 232/17 |
| 5,056,711 | 10/1991 | Bush | 232/17 |
| 5,096,115 | 3/1992 | Hassan | 232/17 |
| 5,400,960 | 3/1995 | Jeffs | 232/45 X |
| 5,407,126 | 4/1995 | Coutlas et al. | 232/17 |
| 5,575,996 | 11/1996 | Chen | 70/279 |
| 5,624,071 | 4/1997 | Sosan | 232/17 |

*Primary Examiner*—Joanne Silbermann
*Assistant Examiner*—William L. Miller

[57] ABSTRACT

A security mailbox includes a housing having a movable side wall hingedly attaches to the top wall. There is an insertion port in the movable side wall and a moisture barrier adjacent the insertion port. There is a security barrier adjacent the insertion port. A keypad lock port and a key lock port extends through the movable side wall. A lock member attached to the second surface includes a key actuated locking mechanism on the first surface extending through the key lock port. The key actuated locking mechanism selectively locks the movable side wall to the bottom wall. The lock member may have a keypad actuated locking mechanism, on the first surface, extending through the keypad lock port that locks the movable side wall to the bottom wall.

6 Claims, 3 Drawing Sheets

10
18
16

11
17
3
22
15
27
28
19
3
101
2
2
100

101
100

23
18
16
15
10
19
26
4
22
11
20
14
4
28
13
27
25
17
20
31
29
12
30

23
25
26
10
24
17
25
19
20

SECURITY MAILBOX

BACKGROUND OF THE INVENTION

1. Field of the Invention

This invention relates to a security mailbox that may be locked and unlocked by different locking mechanisms allowing the user a great deal of latitude in securing and gaining access to the contents of the mailbox.

2. Description of the Related Art

The use of locked mailboxes are known in the related art. More specifically, the locked mailboxes heretofore devised and utilized are known to consist basically of familiar, expected and obvious structural configurations, notwithstanding the myriad of designs encompassed by the crowded related art which have been developed for the fulfillment of countless objectives and requirements.

Known related art mailboxes include U.S. Pat. No. 4,815,656; U.S. Pat. No. 4,865,248; U.S. Pat. No. 5,096,115; U.S. Pat. No. Des. 354,610; U.S. Pat. No. 5,400,960; and U.S. Pat. No. 5,407,126.

U.S. Pat. No. 4,815,656 issued to Smith, et al. on Mar. 28, 1989 discloses a rural mailbox having a camming member with a slot that receives a locking rod when the slot is aligned with the rod by means of a handle used to rotate the cam.

U.S. Pat. No. 4,865,248 issued to Barth on Sep. 12, 1989 shows a post office locked having one or more compartments each with its own lock. The access lock latching mechanism prevents removal of the access key before the access lock has been captured by the custodial lock.

U.S. Pat. No. 5,096,115 issued to Hassan on Mar. 17, 1992 describes a mail theft-preventive mailbox shows a mailbox having an elongated receiving neck leading to a lower storage chamber. The elongated neck serves to prevent the removal of mail by trying to reach into the lower storage chamber. There is a door on the lower storage chamber that may be locked.

U.S. Pat. No. Des. 354,610 issued to Hassan on Jan. 17, 1995 shows an anti-theft mailbox having an elongated receiving neck leading to a lower storage chamber. The elongated neck serves to prevent the removal of mail by trying to reach into the lower storage chamber. There is a door on the lower storage chamber that may be locked.

U.S. Pat. No. 5,400,960 issued to Jeffs on Mar. 28, 1995 describes a letter locker mailbox assembly having a top mail receiving member that when opened will not allow access to the lower mail storage chamber. When the door of the top mail receiving member is closed, the mail placed therein falls into the lower storage chamber. The lower storage chamber is accessed through a lower access door having a lock thereon.

U.S. Pat. No. 5,407,126 issued to Coultas, et al. on Apr. 18, 1995 shows a single-door security mailbox having a lock member on a door that allows the user to set the lock so that the mailman may open the door once without using the key. The door is then closed setting the lock so that a key must be used to open it door a second time.

All these mailboxes endeavor to reduce the chance of mail being taken from the box by thieves. But they lack the ease of operation, convenience and added security of the new and novel dual locking mechanisms of the present invention. The present invention allows the user to change the combination of the keypad should someone learn of the combination that should not have access to the contents of the box. It also allows the user to access the box should the keypad be damaged or if the user forgets the combination by means of the key operated lock.

While these devices fulfill their respective, particular objectives and requirements, the aforementioned patents do not disclose a new security mailbox. The inventive device includes many new and innovative features.

In these respects, the security mailbox according to the present invention substantially departs from the conventional concepts and designs of the related art, and in so doing provides an apparatus primarily developed for the purpose of securely locking a mailbox.

SUMMARY OF THE INVENTION

In view of the foregoing disadvantages inherent in the known types of mailboxes now present in the related art, the present invention provides a new security mailbox construction wherein the same can be utilized for securing locking a mailbox.

The general purpose of the present invention, which will be described subsequently in greater detail, is to provide a new security mailbox apparatus and method which has many of the advantages of the mailboxes mentioned heretofore and many novel features that result in a new security mailbox which is not anticipated, rendered obvious, suggested, or even implied by any of the related art mailboxes, either alone or in any combination thereof.

In one embodiment of the present invention, security mailbox has a housing with a bottom wall and a movable side wall releasably attached to the bottom wall. The movable side wall has a first surface, a second surface and an insertion port. There is a moisture barrier attached to the first surface and a security barrier attached to the second surface both adjacent the insertion port. A lock member is attached to the second surface locking the movable side wall to the bottom wall. The housing may have a fixed side wall attached to the bottom wall and two opposing end walls attached to the bottom wall and to the first side wall. A top wall may be attached to the fixed side wall and to the two opposing end walls. The housing may also have a housing mounting means on the bottom wall.

In another embodiment of the present invention the security mailbox includes a housing having a bottom wall, a fixed side wall attached to the bottom wall, two opposing end walls attached to the bottom wall and to the fixed side wall. A top wall is attached to the fixed side wall and to the two opposing end walls. A movable side wall hingedly attaches to the top wall. The movable side wall has a first surface and a second surface. There is an insertion port in the movable side wall and a moisture barrier, attached to the first surface, adjacent the insertion port. There is also a security barrier, attached to the second surface, adjacent the insertion port. A keypad lock port extends through the movable side wall. There is a key lock port extending through the movable side wall.

A lock member attached to the second surface includes a key actuated locking mechanism on the first surface extending through the key lock port. The key actuated locking mechanism selectively locks the movable side wall to the bottom wall. The lock member may have a keypad actuated locking mechanism, on the first surface, extending through the keypad lock port that locks the movable side wall to the bottom wall.

In many environments, the security of mail in a box is not a given. Many people and business receive checks, credit cards and other valuable items that a thief could take by merely reaching into the commonly used mailbox. The present box with its lock member deters the thief from stealing anything from the box. The present invention is designed to be used on a post like any conventional mailbox or be utilized as a high-security box and attached to a concrete-grounded post or wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new security mailbox apparatus which has many of the advantages of the mailboxes mentioned heretofore and many novel features that result in a new security mailbox which is not anticipated, rendered obvious, suggested, or even implied by any of the related art mailboxes, either alone or in any combination thereof.

It is another object of the present invention to provide a new security mailbox which may be easily and efficiently manufactured and marketed.

It is a further object of the present invention to provide a new security mailbox which is of a durable and reliable construction.

An even further object of the present invention is to provide a new security mailbox which is susceptible of a low cost of manufacture with regard to both materials and labor, and which accordingly is then susceptible of low prices of sale to the consuming public, thereby making such security mailbox economically available to the buying public.

Still yet another object of the present invention is to provide a new security mailbox which provides in the apparatuses of the related art some of the advantages thereof, while simultaneously overcoming some of the disadvantages normally associated therewith.

Still another object of the present invention is to provide a new security mailbox for securely locking a mailbox.

It is another object of this invention to provide securely locked mailbox That allows the user two ways to access the box to remove the contents.

It is a further object of this invention to provide a security mailbox the allows the user to change the combination of the keypad lock by opening the door of the mailbox using the key actuated lock.

It is a further object of this invention to provide a security mailbox that allows the user to access the contents of the mailbox should the combination be forgot or the keypad mechanism damaged.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
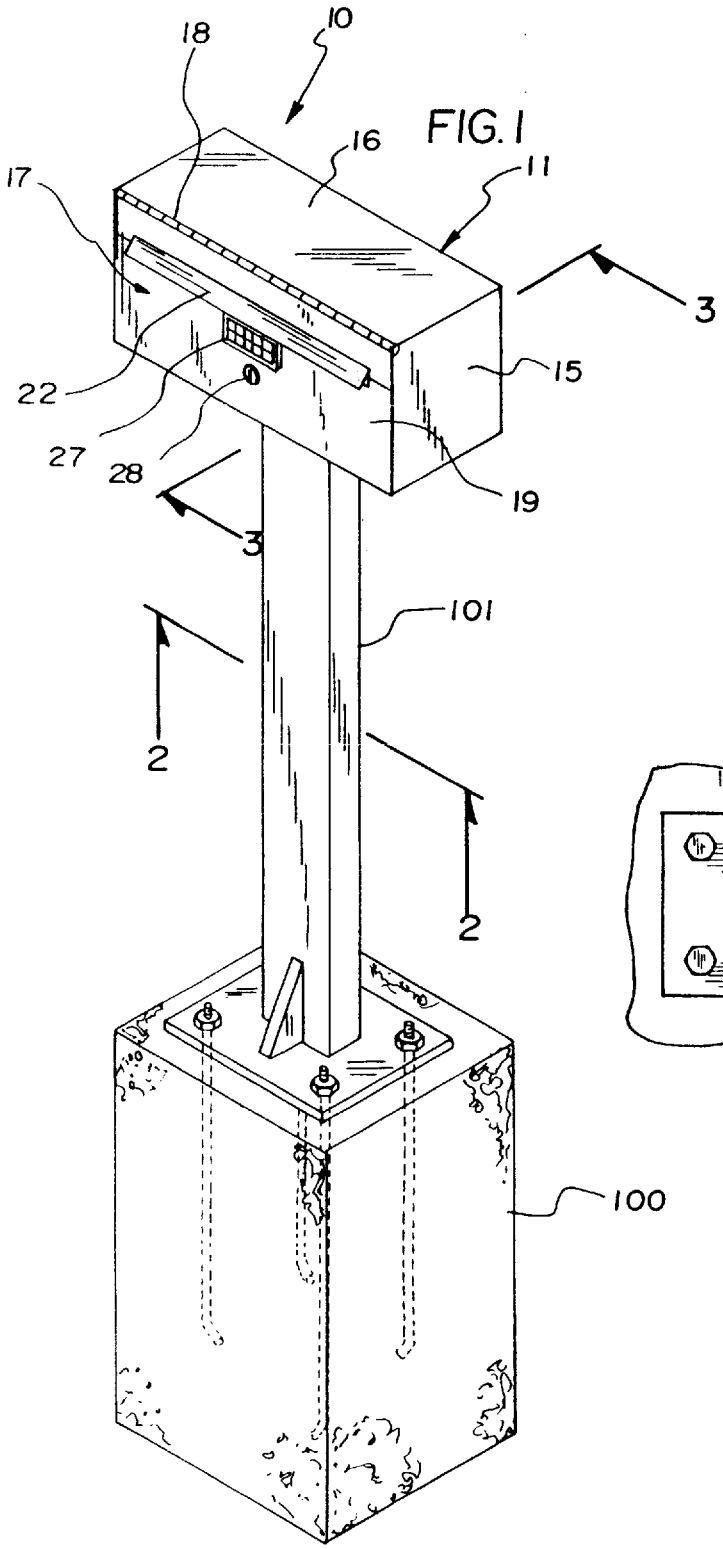
FIG. 1 is a perspective view of the security mailbox mounted on an extension support member which is, in turn, mounted on a concrete base.
Figure 2:
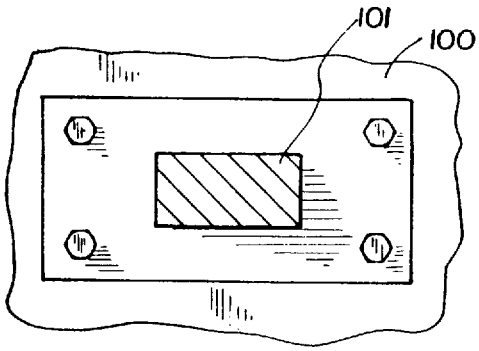
FIG. 2 is a partial cross-sectional view taken along line 2—2 of FIG. 1.
Figure 3:
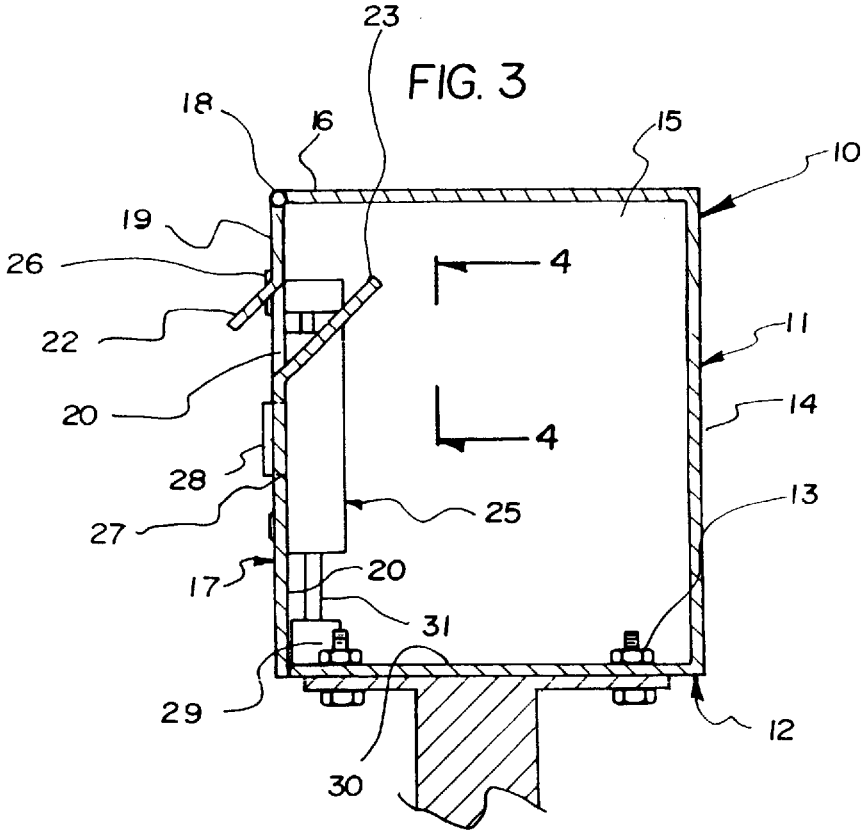
FIG. 3 is a partial cross-sectional view taken along line 3—3 of FIG. 1 showing the movable side wall in the closed position.
Figure 4:
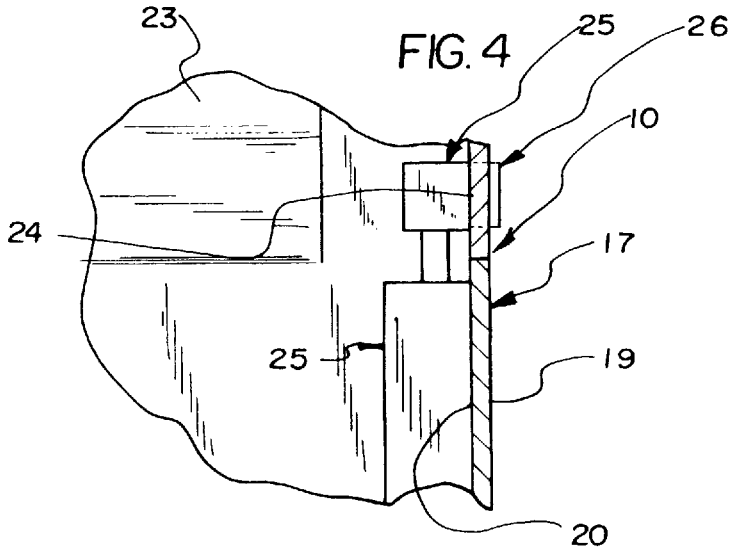
FIG. 4 is an enlarged partial cross-sectional view taken along line 4—4 of FIG. 3.
Figure 5:
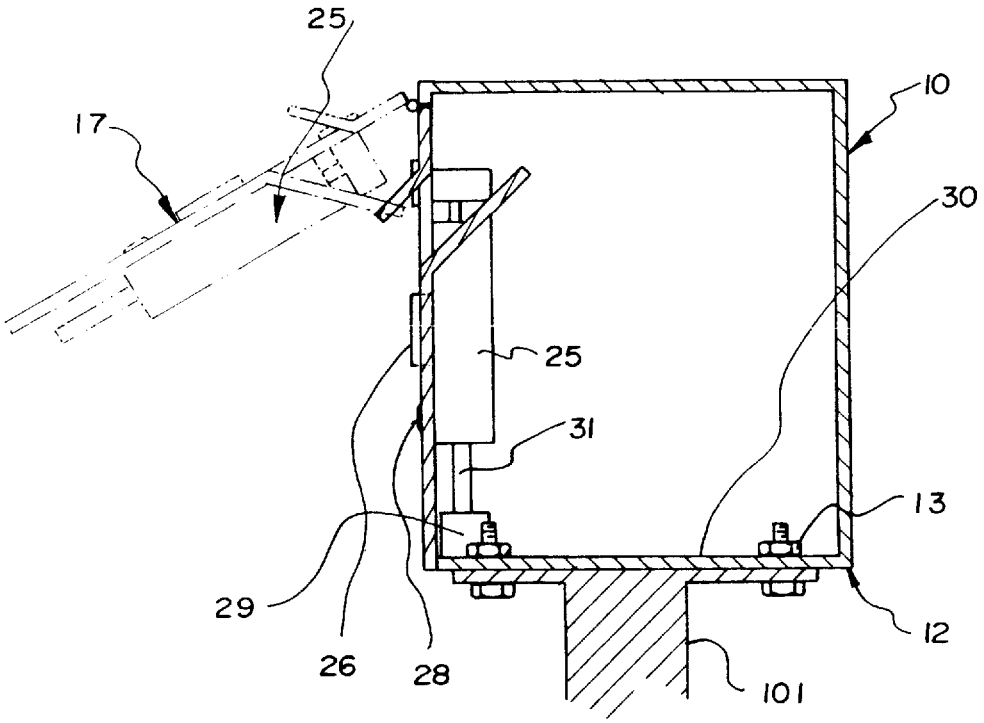
FIG. 5 is partial cross-sectional view taken along line 3—3 of FIG. 1 showing the movable side wall in the open position.

With reference now to the drawings, and in particular to FIGS. 1 through 5 thereof, a new security mailbox embodying the principles and concepts of the present invention and generally designated by the reference numeral 10 will be described.

Referring to FIGS. 1 through a security mailbox 10 is shown having a housing 11. The housing 11 has a bottom wall 12 and a housing mounting means 13 on the bottom wall 12. There is a fixed side wall 14 attached to the bottom wall 12 and two opposing end walls 15 attached to the bottom wall 12 and to the fixed side wall 14. A top wall 16 is attached to the fixed side wall 14 and to the two opposing end walls 15. A movable side wall 17 is hingedly attached, by hinge 18, to the top wall 16.

The movable side wall 17 has a first surface 19 and a second surface 20. There is an insertion port 21 in the movable side wall 17 and a moisture barrier 22, attached to the first surface 19, adjacent the insertion port 21. There is a security barrier 23, attached to the second surface 20, adjacent the insertion port 21. A keypad lock port 24 extends through the movable side wall 17.

A lock member 25 is attached to the second surface 20. The lock member 25 has a keypad actuated locking mechanism 26, on the first surface 19, that extends through the keypad lock port 24. There is a key lock port 27 extending through the movable side wall 17. A key actuated locking mechanism 28 is on the first surface 19. The key actuated locking mechanism 28 extends through the key lock port 27. There is a locking pin receiving member 29 attached to an inner surface 30 of the bottom wall 12.

A telescoping locking pin 31 connects to and is moved by the keypad actuated locking mechanism 26. The telescoping locking pin is 31 also connected to and moved by the key actuated locking mechanism 28. The telescoping locking pin 31 may be moved into or out of the locking pin receiving member 29 by either the keypad actuated locking mechanism 26 or the key actuated locking mechanism 28. The telescoping locking pin 31 selectively telescopes into and out of the locking pin receiving member 29 to selectively lock and unlock the movable side wall 17 to the bottom wall 12.

In operation, the security mailbox 10 is secured to a platform 100, by means of the housing mounting means 13, that is difficult to move such as the concrete base 100 shown in FIG. 1. An extended support 101 may be used to control the height or direction of extension of the security mailbox 10 to accommodate the user's needs. Once the security mailbox 10 is secured in place, the user opens the security mailbox 10, shown open in FIG. 5, using the key actuated lock mechanism 28. The combination the user desires to use on the keypad actuated lock mechanism 26 may then be set. The movable side wall 17 is then closed and the two lock mechanisms placed in their locked positions shown in FIG. 1. Once the movable side wall 17 is locked to the bottom wall 12, activating either lock mechanism will move the telescoping locking pin 31 out of the locking pin receiving member 29 allowing the movable side wall 17 to hinge outward as shown by the dashed lines in FIG. 5. If the user desires to change the combination to the keypad 26 or merely forgets the combination, the key actuated lock 28 may be used to open the security mailbox 10.

The moisture barrier 22 shields the insertion port 20 and reduces the chance of water entering the interior of the housing 11. The security barrier 23 makes it difficult for someone to try to remove anything from the interior of the housing 11 through the insertion port 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A security mailbox comprising:

a housing comprising;

a bottom wall;

a movable side wall, releasably attached to the bottom wall, comprising:

a first surface on the movable side wall;

a second surface on the movable side wall;

an insertion port in the movable side wall;

a moisture barrier, attached to the first surface, adjacent the insertion port; and a security barrier, attached to the second surface, adjacent the insertion port;

a keypad lock port extending through the movable sidewall;

a key lock port extending through the movable side wall; and a lock member attached to the second surface locking the movable side wall to the bottom wall, the lock member comprising:

a key actuated locking mechanism on the first surface and extending through the key lock port; and the key actuated locking mechanism selectively locking the movable side wall to the bottom wall.

2. A security mailbox as described in claim 1 wherein the housing further comprises:

a fixed side wall attached to the bottom wall;

two opposing end walls attached to the bottom wall and to a first side wall; and a top wall attached to the fixed side wall and to the two opposing end walls.

3. A security mailbox as described in claim 1 wherein the housing further comprises a housing mounting means on the bottom wall.

4. A security mailbox comprising:

a housing comprising;

a bottom wall;

a fixed side wall attached to the bottom wall;

two opposing end walls attached to the bottom wall and to the fixed side wall;

a top wall attached to the fixed side wall and to the two opposing end walls;

a movable side wall hingedly attached to the top wall comprising:

a first surface on the movable side wall;

a second surface on the movable side wall;

an insertion port in the movable side wall;

a moisture barrier, attached to the first surface, adjacent the insertion port;

a security barrier, attached to the second surface, adjacent the insertion port;

a keypad lock port extending through the movable side wall;

a key lock port extending through the movable side wall; and a lock member attached to the second surface comprising:

a key actuated locking mechanism on the first surface and extending through the key lock port; and the key actuated locking mechanism selectively locking the movable side wall to the bottom wall.

5. A security mailbox as described in claim 4 wherein the lock member further comprises a keypad actuated locking mechanism, on the first surface, extending through the keypad lock port locking the movable side wall to the bottom wall.

6. A security mailbox comprising:

a housing comprising;

a bottom wall;

a housing mounting means on the bottom wall;

a fixed side wall attached to the bottom wall;

two opposing end walls attached to the bottom wall and to the fixed side wall;

a top wall attached to the fixed side wall and to the two opposing end walls; and a movable side wall hingedly attached to the top wall comprising:

a first surface on the movable side wall;

a second surface on the movable side wall;

an insertion port in the movable side wall;

a moisture barrier, attached to the first surface, adjacent the insertion port;

a security barrier, attached to the second surface, adjacent the insertion port;

a keypad lock port extending through the movable side wall; and a lock member attached to the second surface comprising:

a keypad actuated locking mechanism, on the first surface, extending through the keypad lock port;

a key lock port extending through the movable side wall;

a key actuated locking mechanism on the first surface and extending through the key lock port;

a locking pin receiving member attached to an inner surface of the bottom wall;

a telescoping locking pin connected to and moved by the keypad actuated locking mechanism and connected to and moved by the key actuated locking mechanism; and the telescoping locking pin selectively telescoping into and out of the locking pin receiving member to selectively lock and unlock the movable side wall to the bottom wall.

* * * * *